US006065711A

United States Patent [19]

Plath

[11] Patent Number: 6,065,711

[45] Date of Patent: May 23, 2000

[54] YARN BRAKE AND TEXTILE MACHINE AND YARN FEED DEVICE EQUIPPED THEREWITH

[75] Inventor: Ernst-Dieter Plath, Albstadt, Germany

[73] Assignee: SIPRA Patententwicklungs- und Beteiligungsgesellschaft mbH, Albstadt, Germany

[21] Appl. No.: 09/079,944

[22] Filed: May 15, 1998

[30] Foreign Application Priority Data

May 16, 1997 [DE] Germany ..... 197 20 795

[51] Int. Cl.[7] ..... B65H 59/22; B65H 59/16; D04B 15/48

[52] U.S. Cl. ..... 242/419.4; 242/150 R; 242/150 M; 242/419.9; 66/132 R

[58] Field of Search ..... 242/150 R, 150 M, 242/419.4, 419.9, 365.8; 112/254; 66/132 T, 132 R

[56] References Cited

U.S. PATENT DOCUMENTS

| | | | |
|---|---|---|---|
| 2,029,943 | 2/1936 | Reiners et al. | 242/150 R |
| 3,967,657 | 7/1976 | Cugini | 242/150 R X |
| 4,572,459 | 2/1986 | Kamp et al. . | |
| 4,693,068 | 9/1987 | Matas Gabalda . | |
| 4,705,232 | 11/1987 | Bossart et al. | 242/150 R |
| 5,211,122 | 5/1993 | Lin . | |
| 5,363,786 | 11/1994 | Hampel et al. | 242/150 R X |
| 5,560,557 | 10/1996 | Horvath et al. | 242/150 R X |
| 5,655,721 | 8/1997 | Matsuoka | 242/150 R |

FOREIGN PATENT DOCUMENTS

| | | |
|---|---|---|
| 27 58 334 C2 | 4/1986 | Germany . |
| 35 04 739 A1 | 8/1986 | Germany . |
| 37 11 558 C1 | 6/1988 | Germany . |
| 0 499 218 A1 | 8/1992 | Germany . |
| 43 01 507 C2 | 1/1995 | Germany . |
| 195 31 579 C1 | 1/1997 | Germany . |

*Primary Examiner*—Michael R. Mansen
*Attorney, Agent, or Firm*—Michael J. Striker

[57] ABSTRACT

A yarn brake has a bearing pin, two brake elements for braking a yarn, the brake elements being mounted on the bearing pin for being rotated by the yarn in friction engagement with the brake elements when the yarn is consumed, at least one of the brake elements being axially movable on the bearing pin, a bias mechanism holding the two brake elements in abutment, and a support, the bearing pin being freely rotatable in the support by the brake elements during use of the yarn brake.

17 Claims, 5 Drawing Sheets

YARN BRAKE AND TEXTILE MACHINE AND YARN FEED DEVICE EQUIPPED THEREWITH

BACKGROUND OF THE INVENTION

This invention relates to a yarn brake having a support, a bearing pin, two brake elements mounted on the bearing pin, of which at least one is axially movable on the bearing pin, and a bias mechanism holding the two brake elements in abutment.

Yarn brakes of this kind are inclined in a high degree to contamination, since spin finishes or residues of oil, paraffin or the like adhering to the yarn easily collect on the yarn-contacting or brake surfaces. It is therefore already known (DE 3 504 739 A1) to arrange the brake elements rotatably on the bearing pin. The rotatable mounting of the brake elements serves the purpose of utilizing the tangential forces exerted on the brake elements by the running yarn to make the brake elements shift with a rotary movement and thereby effect constant self-cleaning of the brake elements. However, when using conventional brake elements pressed together by compression springs, the desired free rotation of the brake elements is so strongly impeded by the frictional forces exerted by the compression springs, that particles of dirt which have collected do not then automatically emerge from the space between the brake elements even when large enough openings are provided in their walls. The same applies in principle to yarn brakes in which the brake elements are pressed together with the aid of permanent magnets, of which one is fixed in position (DE 195 31 579 C1), because a corresponding braking moment is exerted on the brake elements by the magnet arrangements. In spite of the tendency towards self-cleaning present in principle, the yam brake therefore has to be cleaned at relatively short intervals of time, which with a machine processing or using yarn with a plurality of yarn guides, e.g. a 96 system circular knitting machine, necessitates expensive cleaning work with corresponding machine down time.

In addition there is the danger that brake elements which are not rotating or are barely rotating wear out quickly or at least grooves and sharp edges result thereon, which must be avoided to save the yarn.

Accordingly yarn brakes have already become known whose brake elements are either forced to rotate with the aid of drive means, which are coupled to the brake elements in the manner of slipping clutches (DE 2 758 334 C2) or are so coupled to a device creating oscillations (EP 0 499 218 A1) that the effect of a force promoting the rotational movement of the brake elements results. Such auxiliary devices are however not acceptable from the economic point of view in machines which use or process a large number of yarns, because they require a huge constructional outlay.

Finally a yarn brake of the kind initially specified is known (DE 4 301 507 C2) in which the brake elements have central holes with diameters which are substantially greater than the outer diameter of the bearing bodies, so that an off-centre mounting relative to their axis of rotation results. However, such a design of the yarn brake makes the use of pre-tensioning element necessary which consist exclusively of magnetic inserts attached to the brake elements. In consequence a self-cleaning action which can be achieved under some circumstances is faced with the disadvantage that the bias on the brake elements and thus the braking force exerted on the yarn can only be adjusted by changing the magnetic inserts, which involves a large loss of time and can only take place in comparatively coarse steps, while continuous adjustment of the braking force is made possible with the springs provided in conventional yam brakes.

SUMMARY OF THE INVENTION

It is, therefore, an object of this invention to provide a yarn brake which more effectively solves the problem of contamination and wear.

A further object is to provide a yarn brake which is also satisfactory from the constructional point of view.

A further object of this invention is to design the yam brake such that it there is no need for an additional drive means.

According to yet another object of this invention the yarn brake is designed such that any kind of ordinary bias element can be provided to adjust the braking force.

Further objects of this invention are to provide a textile machine and a yarn feed device being equipped with such a new yarn brake.

These and other problems are solved by a yarn brake having a support, a bearing pin, two brake elements mounted on the bearing pin, of which at least one is axially movable on the bearing pin, and a bias mechanism holding the two brake elements in abutment, and being characterized in that the bearing pin, the brake elements and the bias mechanism are combined as a whole into an assembly which is freely rotatable in the support.

A textile machine, especially a circular knitting machine, with at least one yarn brake, and a yarn feed device for such a textile machine are characterized in accordance with this invention in that the yarn brake has a support, a bearing pin, two brake elements mounted on the bearing pin, of which at least one is axially movable on the bearing pin, and a bias mechanism holding the two brake elements in abutment wherein the bearing pin, the brake elements and the bias mechanism are combined in an assembly freely rotatable as a whole in the support.

The invention is based on the recognition that the bias elements used to set the braking force cannot prevent the desired free rotation of the brake elements, even when they consist of springs, if the brake arrangement as a whole is designed to rotate freely. The frictional engagement between the yarn and the brake elements is sufficient for the rotation of the whole assembly, especially when this is mounted by means of a low friction bearing in the support, which can be achieved e.g. through a small bearing cross-section.

BRIEF DESCRIPTION OF THE DRAWINGS

The invention will now be explained in more detail with reference to embodiments, in conjunction with the accompanying drawings.

DESCRIPTION OF THE PREFERRED EMBODIMENTS

Figure 1:
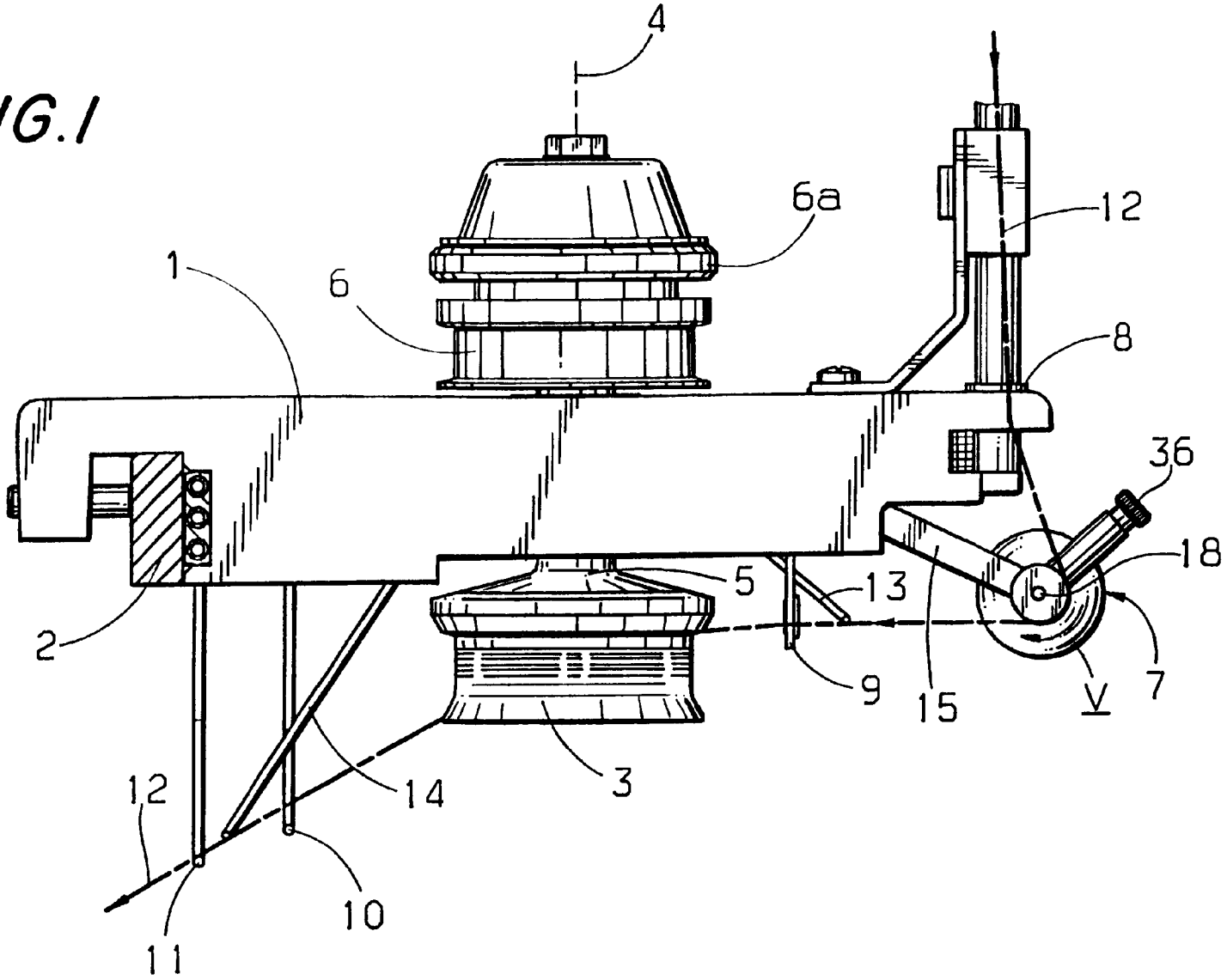
FIG. 1 is a schematic side view of a yarn feed device with a yarn brake.

The yarn feed device shown in FIG. 1 comprises a beam 1 which is releasably attached at one end to a mounting rail 2 of a yarn processing or yarn using machine, e.g. a circular knitting machine. A normal or delivery drum 3 is arranged on the underside of the beam 1 and is mounted to rotate about an axis of rotation 4 and is fixed for this purpose to a shaft 5 mounted rotatably in the beam 1. At least one pulley 6 is mounted rotatably on the part of the shaft 5 projecting above the beam 1 and is driven by a drive, not shown, by means of a belt or the like and can be coupled rotationally fast with the shaft 5 e.g. by means of manually operated clutch 6*a*, in order then for its part to drive the storage or delivery drum 3.

A yarn brake 7 and a yarn eye 8 arranged above it are fixed on the free end of the beam 1. A yarn entry guide element 9, e.g. an eye, is fixed on the underside of the beam 1, between the yarn brake 7 and the delivery drum 3, while two yarn exit guide elements 10 and 11 are provided on the diametrically opposite side of the delivery drum 3, fixed to the underside of the beam 1, and can like the yarn guide element 9 consist of open or closed eyes. A yarn 12 is fed from a supply spool, not shown, through the yarn eye 8, the yarn brake 7 and the guide element 9 obliquely from above and essentially tangentially on to the yarn bearing surface of the delivery drum 3, is wound on this in at least one and preferably several turns and is finally fed tangentially therefrom and through the two guide elements 10 and 11 to a working point of knitting machine or the like, not shown. Feelers 13 and 14, which are also fitted to the beam 1, can monitor the yarn 12 in the usual way.

Yarn feed devices of this kind are generally known to the man skilled in the art (e.g. DE 3 711 558 C1, EP 0 499 218 A1) and do not therefore need to be explained in more detail.

Figure 2:
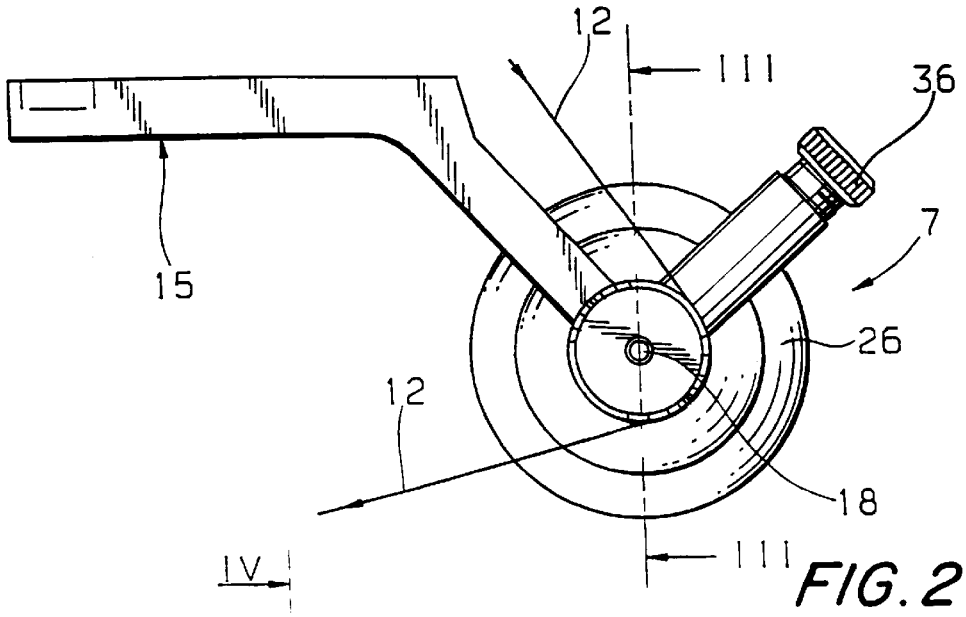
FIG. 2 is an enlarged side view of a yarn brake according to the invention.
Figure 3:
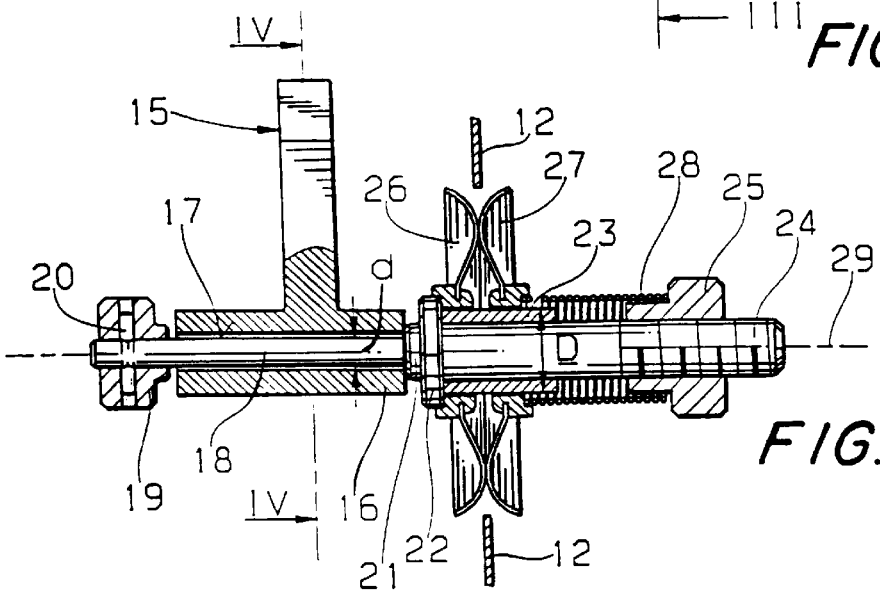
FIG. 3 is a longitudinal section through the yarn brake along the line III—III of FIG. 2.
Figure 4:
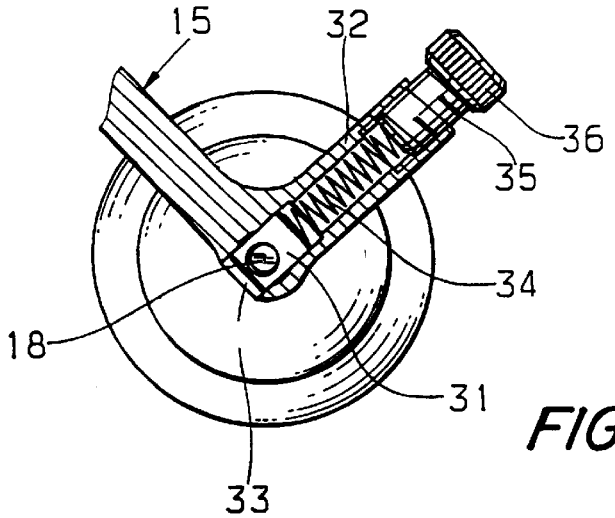
FIG. 4 is a section along the line IV—IV of FIG. 3.

Details of a first embodiment of the yarn brake 7 according to the invention appear from FIGS. 2 to 4. The yarn brake 7 there comprises a support element 15 in the form of an angle bracket or the like, which can be fixed in a manner not shown in detail on the beam 1 or the like according to FIG. 1. The support element 15 has a bearing sleeve 16 with a cylindrical passage 17, in which a cylindrical end of a bearing pin 18 with rotational symmetry is rotatably mounted with sufficient bearing play and thus low friction.

A sleeve-formed end stop 19 is fitted on an end section of the bearing pin 18 projecting from the bearing sleeve 16 and is fixed rotationally fast and axially immovably on the bearing pin 17 by means of a cross pin 20, which passes through aligned transverse bores in the end stop 19 and the bearing pin 18 and has a larger cross-section than the passage 17. Correspondingly the section of the bearing pin 18 projecting from the passage 17 on the other side of the bearing sleeve 16 is provided with an abutment 21, whose diameter is greater than the diameter of the passage 17 and which has such a spacing from the end stop 19 that the sleeve 16 is arranged between the two with a predetermined axial play of 0.3 mm for example and the bearing pin 18 is rotatable easily in the bearing sleeve 16.

On the opposite end from the abutment 21, the bearing pin 18 has a stop element 22, which like the abutment 21 is preferably in the form of a bead formed on and surrounding the bearing pin 18. Alternatively the abutment 21 could also be formed as a spring ring and the stop element 22 as an annular washer bearing against it. Other constructions are also possible.

On the side of the stop element 22 facing away from the abutment 21 there is a hollow, cylindrical bearing body 23, preferably in the form of a ceramic tube, which is fitted over the bearing pin 18 and is fixed thereto e.g. by an adhesive or by clamping and therefore forms an intergral part of the bearing pin 18. The other end of the bearing pin 18, remote from the bearing sleeve 16, is finally provided with an external threaded section 24, on which an adjusting nut 25 with a corresponding internal thread is screwed.

Two brake elements 26,27 are rotatably and axially movably mounted with sufficient radial play on the bearing body 23 and are advantageously formed in known manner like discs, dishes or plates and can have holes in the sides, not shown, through which impurities collecting between them can emerge axially. The one brake element 26 is supported against the stop element 22 while the side of the brake element 27 facing away from this is subjected to the action of a bias element 28 in the form of a compression spring fitted over the bearing pin 18 and compressed between the brake element 27 and the adjusting nut 25. The adjusting nut 25 and the bias element 28 form a bias mechanism through which the biasing force acting on the brake element 27 or the yarn braking force can be altered by turning and thus axially displacing the adjusting nut 25.

On account of the described arrangement the brake elements 26,27 can either turn on the bearing pin 18 or together with the assembly as a whole formed by them, the bearing pin 18, the adjusting nut 25 and the bias element 28, about an axis of rotation 29 defined by the bearing pin 18 in the support 15 or its bearing sleeve 16. When the yarn 12 is running and can in accordance with FIG. 1 also wrap partially round the bearing body 23 acting as the yarn guide or deflecting section and preferably therefore consisting of a wear resistant material, rotation of the brake elements 26,27 in the yarn running direction can take place in each case on account of the frictional engagement between the yarn 12 and the brake elements 26 and 27 pressed together by the bias element 28. If there is no rotation of the brake elements 26,27 about the bearing pin 18 or only incomplete rotation, e.g. because the existing friction or that caused by impurities creates too great an opposing torque, or because the bias element 28 exerts too great a frictional moment on the brake elements 26,27, then at least the complete assembly turns about the axis of rotation 29. This last mentioned rotation takes place independently of the opposing torques acting on the brake elements 26,27, especially when the rotatable bearing of the assembly in the sleeve 16 is effected with a smaller cross-section than the rotatable bearing of the brake elements 26,27 on the bearing pin 18. This provision is met in the described arrangement if the outer diameter D of the bearing body 23 is greater than the outer diameter d of the end of the bearing pin 18 fitted in the bearing sleeve 16, so that the opposing torque exerted on this end is comparatively small.

If the bearing pin 18 is mounted very freely running or with low friction in the bearing sleeve 16 on account of the described arrangement, there is a danger that the whole assembly will always rotate with the yarn speed. This could lead to the yarn 12 jumping out from its position between the brake elements 26,27 or the assembly running on account of its inertia with a sudden braking of the machine or when there is a desired yarn stoppage, so that a loose yarn loop forms, which results in a stop signal for the machine through the feeler 13 (FIG. 1), even when this is not desired.

In order to avoid such disturbances a brake device is associated with the described assembly in accordance with the invention. This includes in the embodiment according to FIGS. 2 to 4 a brake block 31 mounted in the support 15 (FIG. 4), which acts on the end of the bearing pin 18 mounted in the bearing sleeve 16. The support 15 is provided for this with an extension 32 running radially from the bearing sleeve 16, with a continuous bore 33 intersecting the passage 17, which receives the brake block 31. The brake block 31 is preferably held in abutment with the bearing pin 18 by one end of a bias spring 34. The other end of the bias spring 34 bears on an adjusting screw 35 which is axially movable in the bore 33 and which can be fixed on an adjusting nut screwed on to an externally threaded section of the extension 32 or consist of a threaded screw with a knurled head 36 screwed into an internally threaded section of the bore 33. The very low friction bearing of the bearing pin 18 can be artificially increased again by means of the adjusting screw 35 and the bias spring 34, i.e. the braking force of the brake device can be set individually. It is thus possible to set the braking force for the rotational movement of the described assembly deliberately and independently of the yarn braking force set by means of the bias element 28, as can be desirable for example in order to take account of different frictional values of the yarn being used.

The yarn braking force can be set individually by means of the adjusting nut 25. The end stop 19 can be held fast manually in order to prevent the whole assembly being rotated when turning the adjusting nut 25.

Figure 5:
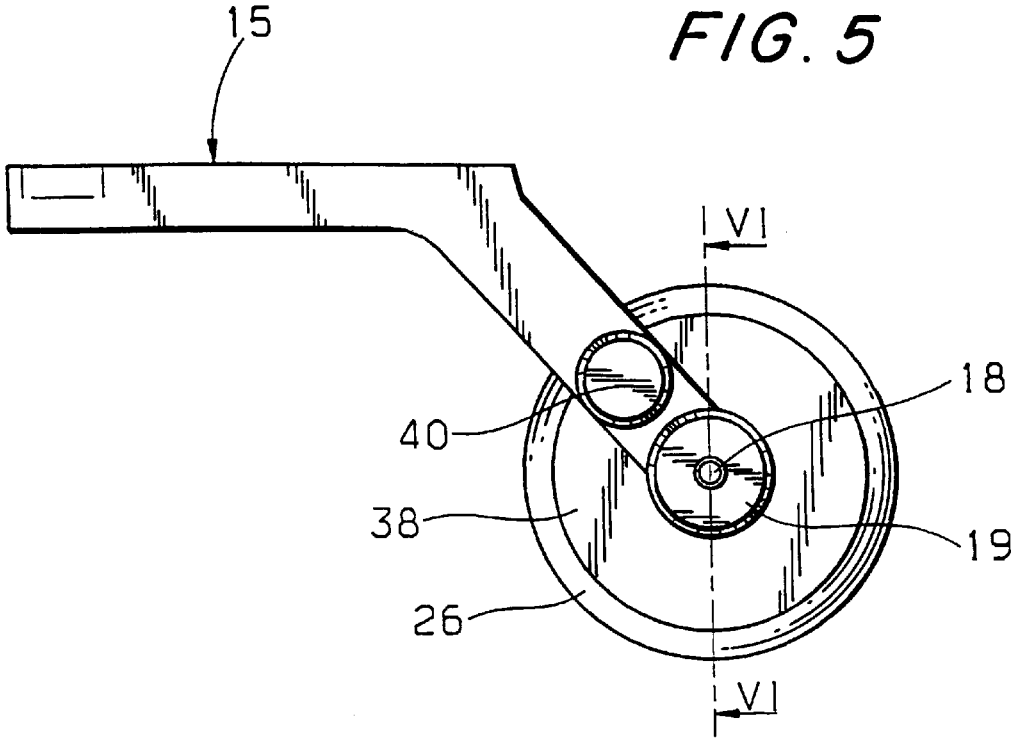
FIGS. 5 and 6 are side view and a section on the line VI—VI of FIG. 5 respectively of a second embodiment of the yarn brake according to the invention.
Figure 6:
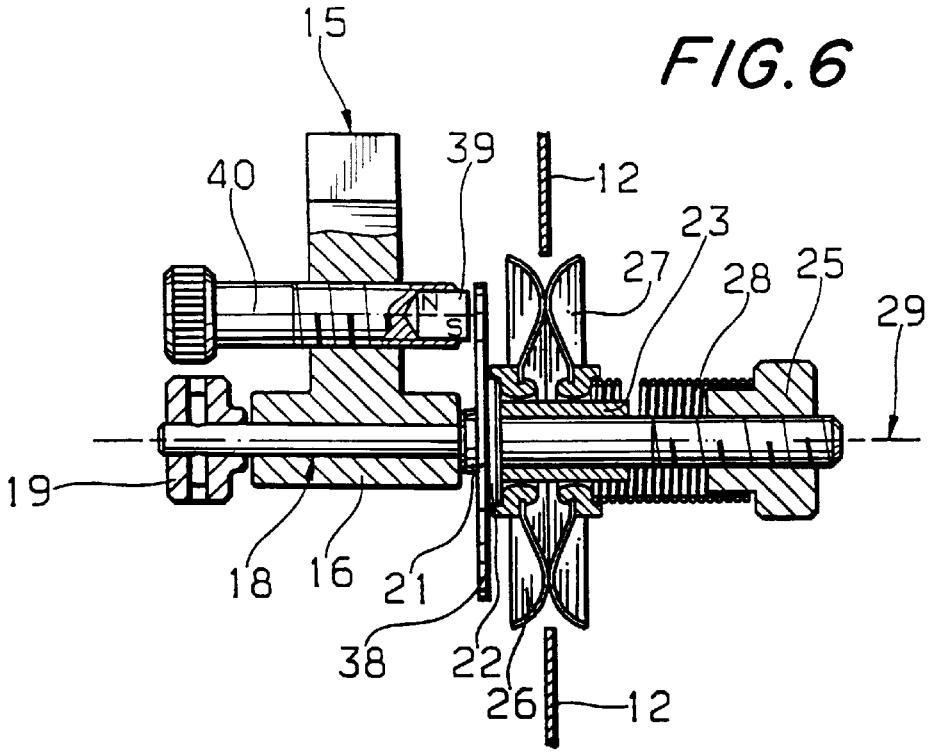

The embodiment according to FIGS. 5 and 6 differs from the embodiment according to FIGS. 2 to 4 solely in the brake device. Like parts are therefore given the same reference numerals. The brake device here includes a brake disc 38, preferably of a ferromagnetic material, fixed rotationally fast on the bearing pin 18 between the abutment 21 and the stop element 22 and a brake magnet 39 acting thereon and mounted in the support 15 and which can in particular be a permanent magnet. The brake magnet 39 is preferably mounted on a adjusting rod 40 axially movable in the support 15, formed as a threaded screw for example, so that its spacing from the brake disc 38 can be altered to aler the braking force acting on the bearing pin 18. The brake device acts in the manner of an eddy current brake.

Figure 7:
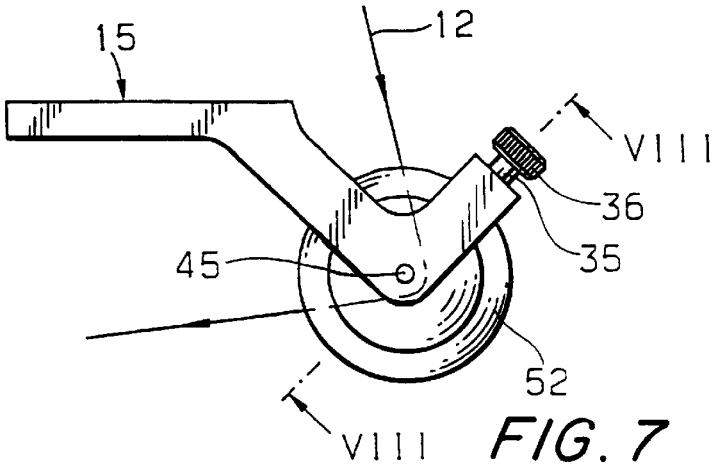
FIG. 7 is a side view of a third embodiment of the yarn brake according to the invention.
Figure 8:
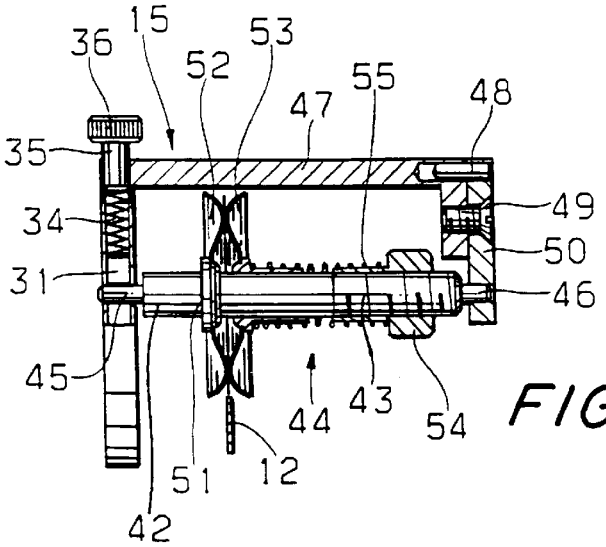
FIG. 8 is a section along the line VIII—VIII of FIG. 7.
Figure 9:
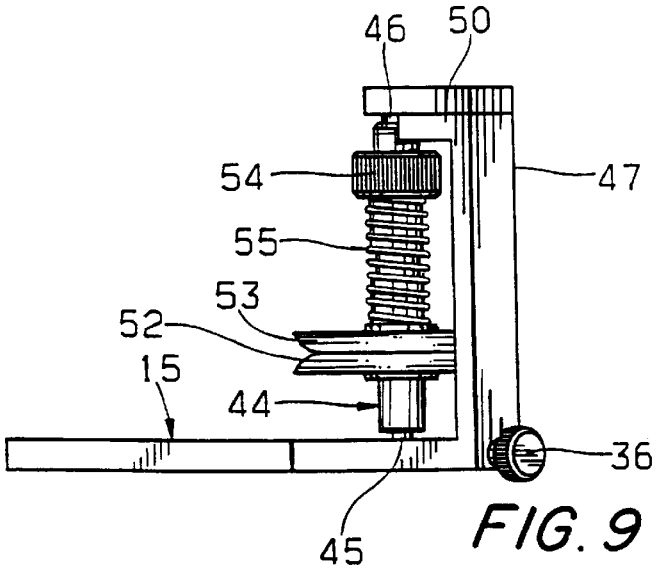
FIG. 9 is a plan view of the yarn brake according to FIG. 7.

While the bearing pin 18 is mounted at one end in the embodiments according to FIGS. 2 to 6, in the embodiment according to FIGS. 7 to 9 a bearing pin 44 is provided consisting of two coaxial sections 42,43 connected together. The two sections 42,43 are provided with journals 45,46 at their opposite ends, which preferably have a very small diameter and project into corresponding bearing bores in the support 15. The support 15 additionally comprises a vertically extending arm 47 to whose free end a mounting plate 50 is fixed by means of a locating pin 48 and a screw 49, this plate having the bearing bore for the journal 46 and facilitating simple mounting of the bearing pin 44. Similarly to FIGS. 2 to 6, a stop element 51 for two axially movable brake elements 52,53 mounted rotatably on the section 42 is fixed on the section 42 of the bearing pin 44. The section 43 of the bearing pin 44 having the journal 46 on one end is provided with an externally threaded section at the other end. This is screwed into an internally threaded section which is provided on the end of the section 42 remote from the journal 45 and is thereby connected to the section 42. Moreover the section 43 has a radially projecting adjusting knob 54, formed as a projecting bead or the like and corresponding to the adjusting nut 25 according to FIG. 3, a bias element 55 in the form of a spring fitted over the bearing pin 44 being supported analogously to FIGS. 2 to 6 between this adjusting knob 54 and the brake element 53. By turning the adjusting knob 54 and through the displacement of the section 43 in the longitudinal direction thus effected, the braking force acting on the yarn 12 can accordingly be adjusted, the length of the part of the journal 46 guided in the associated bearing bore being chosen in accordance with the desired path of adjustment and the distance between the parts 43 and 50. Furthermore the arrangement is such, like in FIGS. 2 to 6, that the bearing pin 44 is mounted with sufficient axial play between the bearing plate 50 and the opposing part of the support 15 and it can turn very freely. Otherwise the manner of operation of the yarn brake according to FIGS. 7 to 9 is analogous to the manner of operation of the yarn brakes according to FIGS. 2 to 6. In order to avoid rotation of the whole assembly or of the bias mechanism formed by the bias element 55 and the adjusting knob 54 when adjusting the braking force, the section 42 can be grasped manually at the same time when actuating the adjusting knob 54 and be held fast.

The embodiment described with reference to FIGS. 7 to 9 can be modified in that the bearing pin 44 including the journals 45 and 46 is made in one piece. In this case, by analogy with FIG. 3, the section given the reference numeral 43 in FIG. 8 is provided with an external thread and the adjusting knob 54 is formed as a nut fitted on the external thread. In comparison with the embodiment according to FIG. 3 the bearing pin 18 shown there would simply be provided with a second bearing point at the free end having the threaded section 24.

Figure 10:
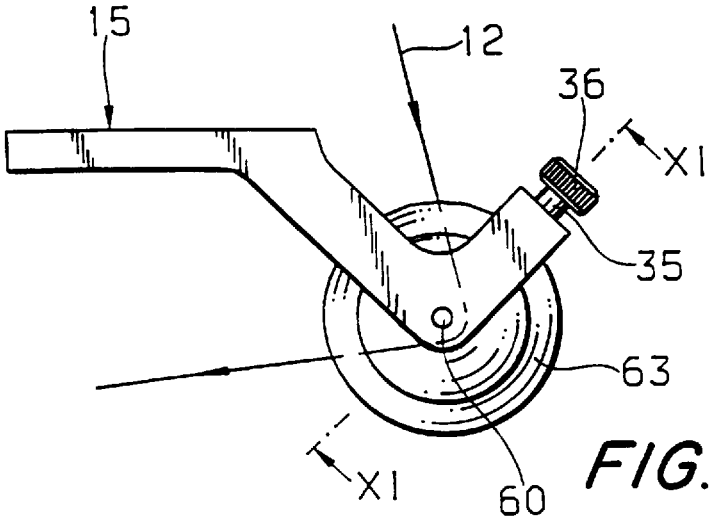
FIGS. 10 to 12 are views corresponding to FIGS. 7 to 9 of a fourth embodiment of the yarn brake according to the invention.
Figure 11:
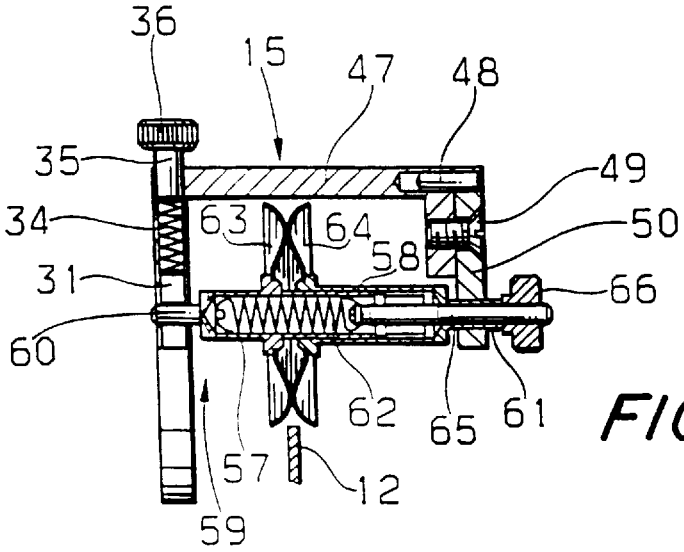
Figure 12:
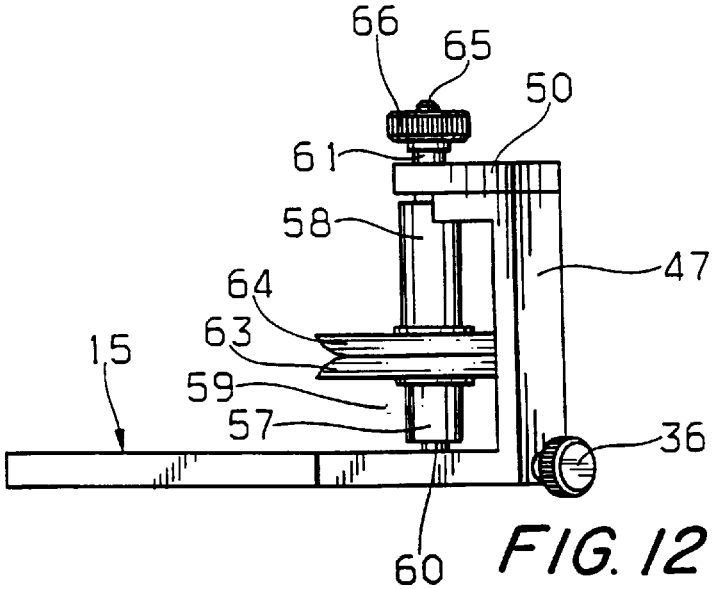

The embodiment according to FIGS. 10 to 12 includes a bearing pin 59 assembled from two sections 57,58. At least one of the sections, here the section 58, is internally hollow, so that the section 57 can be fitted telescopically therein. Each section 57,58 is moreover provided with a journal 60,61 with a small diameter, which is fitted like in FIGS. 7 to 9 in a suitably formed support 15.

Differing from the previously described embodiments, in the embodiment according to FIGS. 10 to 12 an internal bias element 62 is provided for two brake elements 63,64. The bias element 62 here consists of a tension spring, whose one end is fixed in the preferably likewise hollow section 57 and whose other end is fixed to an adjusting screw 65 passing through the other section 58. The adjusting screw 65 also passes through the journal 61 of the section 58 and has an externally threaded section on an end projecting beyond the mounting plate 50, on which an adjusting nut 66 is screwed, which abuts inside against an end section of the journal 61 also projecting out of the mounting plate 50. Accordingly, by turning the adjusting nut 66 the spring is therefore tensioned more or less and the section 57 is thus drawn more or less deeply in the axial direction into the section 58. Since the adjusting nut 66 only bears on the journal 61 and not on the mounting plate 50, it can itself not create any braking moment, as could arise if it abutted the mounting plate 50. In order to avoid the whole assembly turning when actuating the adjusting nut 66, the section 58 can be grasped manually and held fast for example.

The brake elements 63,64 are so supported at least axially on the associated sections 57,58 in this embodiment that they participate in their axial movement effected by the bias element 62. In addition the brake element 63 for example is rotatable in an annular groove of the section 57 but is axially immovable while the brake element 64 is mounted rotatably and axially movably on the section 57, on account of the bias however in abutment with the inner end face of the section 58, located on the left in FIG. 11, so that it cannot shift axially under the action of the tension of the bias element 62. Alternatively the brake elements 63,64 could also be mounted rotatably on the sections 57,58 and bear on the sides facing away from each other on corresponding shoulders or the like on the sections 57,58, which prevent axial movement. Other mounts for the brake elements 63,64 are possible.

In order to avoid too free rotation of the assembly formed in the embodiments according to FIGS. 7 to 12 from the bearing pin 44 or 59, the bias elements 55 and 62 respectively, the brake elements 52,53 and 63,64 respectively and the adjusting nut 66 or adjusting knob 54, an additional and preferably adjustable brake device is provided in these embodiments, acting for example on at least one of the journals 45,46 or 60,61. This brake device is formed like in FIGS. 2 to 4 for example, so that the same parts are given the same reference numerals in FIGS. 7 to 12 for the sake of simplicity.

The invention is not limited to the described embodiments, which can be modified in many ways. For example, the free moving rotary mounting of the various bearing pins can be achieved in that these are provided with conically tapering ends at their ends and are mounted in the support 15 in the manner of needle bearings, especially when using magnetically acting brake devices. By "free moving" is to be understood that such a free moving bearing is provided that the whole assembly can be caused to rotate on account of the frictional effect between the yarn 12 and the associated brake elements or the yarn guide sections (e.g. 23). Furthermore it is not necessary in principle for the brake elements to be mounted rotatably on the bearing pins, since with a free moving mounting thereof, the whole assembly can always rotate and only one of the brake elements needs to be mounted axially movably for adjustment of the desired yam braking force. Moreover it is clear to the man in the art that other bearings and bias mechanisms could be provided. In particular the assembly consisting of the brake elements, the bias element, the adjusting nut or the adjusting knob and optionally the ceramic sleeve could be mounted on a common sleeve-like bearing pin, which for its part is mounted easily rotatably on a spindle fixed in position in the support 15. Finally it is evident that the described features of the yarn brakes could also be used in combinations other than those illustrated and described.

Moreover the described yarn brake can be used anywhere where running yarns are handled or processed, especially naturally in textile machines and there in the yarn path of a running yarn. The yarn brake can be used to particular advantage like in FIG. 1 also on a yarn supply device mounted on or as an integral component thereof.

While the invention has been illustrated and described as embodied in a yarn brake for a circular knitting machine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and set forth in the following appended claims:

1. A yarn brake, comprising a bearing pin; two brake elements for braking a yarn, said brake elements being mounted on said bearing pin for being rotated by said yarn in friction engagement with said brake elements when said yarn is consumed, at least one of said brake elements being axially movable on said bearing pin; a bias mechanism holding said two brake elements in abutment; and a support, said bearing pin being freely rotatable in said support during use of said yarn brake.

2. A yarn brake as defined in claim 1, wherein said bearing pin has at least one end, said assembly being rotatably mounted on said support on said at least one end of said bearing pin.

3. A yarn brake as defined in claim 1, wherein said bias mechanism includes a spring.

4. A yarn brake as defined in claim 3, and further comprising an adjusting member which is mounted rotatable and axially movable on said bearing pin, said adjusting member acting on said spring.

5. A yarn brake as defined in claim 3, wherein said bias spring has a spring force and wherein the bias mechanism has means for adjusting said spring force.

6. A yarn brake as defined in claim 1, and further comprising a brake device for braking said bearing pin during rotation thereof.

7. A yarn brake as defined in claim 6, wherein said brake device has a brake block mounted in said support and adapted to act on said one end.

8. A yarn brake as defined in claim 7, and further comprising a bias spring acting on said brake block.

9. A yarn brake as defined in claim 6, wherein said brake device has a brake disk fixed to said bearing pin and a brake magnet acting on said brake disk and mounted in said support.

10. A yarn brake as defined in claim 9, wherein said brake device has means for adjusting said magnet.

11. A yarn brake as defined in claim 1, wherein said bearing pin has at least two sections which are movable in a longitudinal direction relative to one another and mounted rotatably in said support.

12. A yarn brake as defined in claim 11, wherein said two sections are slidable telescopably in one another, said bias mechanism including a tension spring arranged in a hollow space of at least one of said sections.

13. A yarn brake as defined in claim 12, and further comprising an adjusting screw, said tension spring having one end which is fixed to one of said two sections and another end which is fixed to said adjusting screw a hollow journal provided on the other of said sections and mounted in said support, said adjusting screw passing through said hollow journal and being provided on an end projecting out of said journal with a threaded section; and an adjusting nut received in said threaded section.

14. A yarn brake as defined in claim 1, wherein said brake device has a braking force and means for adjusting said braking force.

15. A yarn brake as defined in claim 1, wherein said at least axially movable brake element is mounted rotatably on said bearing pin.

16. A yarn brake as defined in claim 15, wherein said bearing pin has a yarn guide section with a predetermined diameter and is rotatably mounted in said support with a portion having a cross-section which is smaller than said diameter of said yarn guide section.

17. A yarn feed device for a textile machine, comprising a feeding means support element; and at least one yarn brake mounted to said support element and including a bearing pin, two brake elements for braking a yarn and being mounted on said bearing pin for being rotated by said yarn in frictional engagement with said brake elements when said yarn is consumed, at least one of said brake elements being axially movable on said bearing pin; a bias mechanism holding said two brake elements in abutment; and a support, said bearing pin being freely rotatable in said support during use of said yarn brake.

* * * * *